US009339816B2

(12) United States Patent
Gruss et al.

(10) Patent No.: US 9,339,816 B2
(45) Date of Patent: May 17, 2016

(54) REACTOR ARRAY FOR PRODUCING AND ANALYZING PRODUCTS

(75) Inventors: Michael Gruss, Aachen (DE); Matthias Ridder, Aachen (DE)

(73) Assignee: Grünenthal GmbH, Aachen (DE)

( * ) Notice: Subject to any disclaimer, the term of this patent is extended or adjusted under 35 U.S.C. 154(b) by 241 days.

(21) Appl. No.: 13/093,428

(22) Filed: Apr. 25, 2011

(65) Prior Publication Data

US 2011/0257048 A1 Oct. 20, 2011

Related U.S. Application Data

(63) Continuation of application No. PCT/EP2009/007643, filed on Oct. 26, 2009.

(30) Foreign Application Priority Data

Oct. 28, 2008 (EP) ..... 08018762

(51) Int. Cl.
*B01L 3/00* (2006.01)

(52) U.S. Cl.
CPC ..... *B01L 3/50853* (2013.01); *B01L 2200/142* (2013.01); *B01L 2300/042* (2013.01); *B01L 2300/0829* (2013.01)

(58) Field of Classification Search
CPC .... B01L 2300/0609; B01L 3/523; B01L 9/52
USPC ..... 422/552, 553, 82.09; 378/208, 75; 356/244; 73/864.91
See application file for complete search history.

(56) References Cited

U.S. PATENT DOCUMENTS

| | | | | |
|---|---|---|---|---|
| 6,106,783 | A * | 8/2000 | Gamble | 422/553 |
| 6,507,636 | B1 | 1/2003 | Lehmann et al. | |
| 2002/0195448 | A1 | 12/2002 | Mathus et al. | |
| 2003/0235519 | A1 | 12/2003 | Sha et al. | |
| 2004/0239044 | A1 * | 12/2004 | Blatter et al. | 277/602 |
| 2004/0258563 | A1 | 12/2004 | Young et al. | |
| 2005/0019225 | A1 | 1/2005 | Sanadi | |
| 2005/0173632 | A1 * | 8/2005 | Behar et al. | 250/311 |
| 2006/0205064 | A1 | 9/2006 | Tajima | |

FOREIGN PATENT DOCUMENTS

| | | | |
|---|---|---|---|
| EP | 0341587 | A2 | 11/1989 |
| EP | 1300462 | A | 4/2003 |
| EP | 1972377 | A2 | 9/2008 |

* cited by examiner

*Primary Examiner* — Natalia Levkovich
(74) *Attorney, Agent, or Firm* — Norris McLaughlin & Marcus, P.A.; Christa Hildebrand

(57) ABSTRACT

The present invention relates to a reactor array for producing and/or analyzing products, comprising a plurality of vessels in which products can be produced on a preparative or analytical scale.

10 Claims, 6 Drawing Sheets

REACTOR ARRAY FOR PRODUCING AND ANALYZING PRODUCTS

This is a continuation application of PCT/EP2009/007643, filed on Oct. 26, 2009 and claiming priority to EP 08018762, filed on Oct. 28, 2008.

BACKGROUND OF THE INVENTION (1) Field of the Invention

The present invention relates to a reactor array for producing and/or analysing products, comprising a plurality of vessels in which products can be produced and/or analysed on a preparative or analytical scale.

(2) Description of Related Art

Analyses of substances in a medium- or high-throughput method require that reactions and/or analytical measurements are carried out in arrays which comprise a plurality of vessels in or on which the respective product is located. One analysis method in this context is x-ray powder diffractometry, which is a standard method for determining the polymorphism of substances, for example. For this measurement, an x-ray is successively directed onto each product for analysis on the sample carrier, and the portion of the radiation diffracted therefrom is evaluated. This method can be implemented in transmission geometry or reflection geometry. No reactors are currently known from the prior art, for example EP 1 972 377 A2 and U.S. Pat. No. 6,507,636 B1, which simultaneously meet the requirements for chemical synthesis and/or crystallisation and those for an optimum sample carrier, for example for x-ray chemical analysis, as optimally as possible.

BRIEF SUMMARY OF THE INVENTION

The object of the present invention was therefore to provide a reactor array which meets the aforementioned requirements.

The object is achieved by a reactor array for producing and/or analysing products, comprising a plurality of vessels in which products can be produced and/or analysed on a preparative or analytical scale, wherein each vessel comprises a gastight lid at least at times, and at least the base of each vessel exhibits low x-ray absorptance.

According to the invention, the reactor array comprises a plurality of vessels for producing and/or analysing products. Products are produced on a preparative or analytic scale in these vessels, or the vessels are filled with products in order to analyse said products. Within the meaning of the invention, a preparative or analytic scale involves vessels having up to 50 ml filling volume and/or 5 g filling weight, preferably up to 2 ml filling volume and/or 500 mg filling weight, particularly preferably up to 0.5 ml filling volume and/or 50 mg filling weight of the substance to be synthesised and/or analysed. According to the invention, each of these vessels also comprises a gastight lid at least at times, which in particular retains vapours of organic solvents at temperatures preferably of 0-120° C. The loss of solvent or gas by leaking is preferably at most 20% of the filling volume in 24 hours, particularly preferably at most 10% of the filling volume in 24 hours, most preferably at most 1% of the filling volume in 24 hours, at a temperature of 30° C. below the boiling point, preferably at 15° C. below the boiling point, most preferably at the boiling point of the solvent or gas, based on the pressure surrounding the vessel. In particular, the lids are located on the vessels during the production and/or before the analysis of the products. The lid is preferably removed for the analysis.

The vessel and/or the lid thereof preferably consist of a chemically inert material and/or are coated with a chemically inert material. Examples of chemically inert materials include glass, ceramic material, high-grade steels and some plastics materials. The vessel and/or the lid thereof are preferably shaped and/or dimensioned in such a way as to be dimensionally stable against both positive and negative pressure. It is also preferred for the vessel to be manufactured from a thermally conductive material, in such a way that the product can be manufactured and/or analysed while introducing and/or removing heat. It is further preferred for the vessel to be easy to fill and easy to empty. For this purpose, it may for example have no undercuts and no sharp corners. The vessel preferably comprises means for thorough mixing in the vessel when producing the product and/or during the analysis. This thorough mixing is preferably provided by shaking and/or stirring. The lid and/or the vessel are preferably produced by thermoforming, casting, extruding or injection moulding a plastics material. Cutting methods and rapid prototyping (solidifying a plastics material powder or granulate) are further preferred production methods. In this way, a plurality of lids or vessels can be produced simultaneously. They may be separated, if desired, before or after assembling the lid and the vessel.

According to the invention, in particular the base of the vessel is configured to have as high an x-ray transmittance as possible, preferably in a wavelength range of 0.45-2.5 Å. For this purpose, the base of the vessel preferably has a thickness less than or equal to 5 mm, particularly preferably less than or equal to 100 μm, and is particularly preferably manufactured from an x-ray-amorphous material.

Preferably, the filling level and filling density of the products in the vessels is identical in each case in so far as possible, so as to obtain measurements which are as comparable as possible, both in the x-ray reflection analysis and in the x-ray transmission analysis.

Preferably, the lids of the individual vessels are interconnected, in such a way that they can be applied to or removed from all the vessels in one operation.

Preferably, the vessels are mounted on a plate in mountings provided therefor. A plate within the meaning of the invention need not be a continuous plate, but may comprise recesses. A formation in which the mountings of the individual vessels are interconnected by webs is also a plate within the meaning of the invention. Rather than being planar, the plate according to the invention will also generally comprise elevations and/or indentations, for example for mounting the vessels or for removing the lids of the vessels.

Preferably, the mounting of the vessels each comprises one or more mountings and/or a common heat exchange means with which each vessel can be heated or cooled. Preferably, the temperature in each vessel can be adjusted individually.

Preferably, the plate comprises a lid opener in each case in the region of the mounting of the vessels, with which opener the lid of the vessel can be removed, preferably automatically. This is preferably done before the analysis of the products, in particular immediately before. This is advantageous in particular for x-ray analysis, since the lid thus no longer presents an obstacle to the transmission of the x-rays. Preferably, all of the lids are removed from the respective vessels simultaneously. In a preferred embodiment, the lids are removed by deformation thereof, particularly preferably reversible deformation. The deformation releases a positive and/or non-positive connection between the lid and the vessel and the lid can be removed from the respective vessel. The lid is preferably removed by a lowering movement of the vessel and the lid.

Preferably, each lid comprises means for fastening for example process-related equipment, metering means and/or measuring means onto the lid.

In a preferred embodiment, the vessel is arranged rotatably in the mounting in each case. This preferred embodiment of the present invention has the advantage that the vessel can be rotated, for example during the analysis of the product located therein. This makes it possible at least to reduce measuring errors caused for example by different filling heights, different filling densities and a particular alignment of crystals or preferred orientation of the crystals.

Preferably, the vessels each comprise a drive means for this purpose. This drive means may cooperate in a positive and/or non-positive fit with a drive belt or a drive wheel, for example. However, the vessels may also comprise contactless drive means, for example means against which a stream of gas or liquid flows or which set the respective vessel in rotation by way of an electromagnetic effect.

Preferably, the drive is provided contactlessly by a temperature-controllable stream of gas or liquid which makes it possible to set different temperatures. This is advantageous for example when analysing substances having temperature-dependent properties (for example polymorphs or solvates).

In a preferred embodiment, the respective vessel is arranged in a mounting provided separately from the plate, in which case this mounting can then preferably be set in rotation.

A further subject-matter of the present invention is a lid array which comprises a plurality of individual lids which are arranged in a grid pattern. The lid array according to the invention is adapted in particular for use as a retrofit kit for previously existing reactor arrays.

Preferably, the lid array is manufactured from a flexible material. Within the meaning of the invention, flexible means that the material of the lid array is sufficiently pliable that it can be removed from the reactor array gradually by bending, without requiring a removal aid and without the lid being damaged, and the reactor array can subsequently be resealed.

Preferably, each lid comprises a seal. This seal can be made of the same material as the lid or a different type of material.

BRIEF DESCRIPTION OF THE SEVERAL VIEWS OF THE DRAWING(S)

In the following, the invention is explained by way of FIG. 1-13. These explanations are merely exemplary and do not limit the general idea of the invention.

DETAILED DESCRIPTION OF THE INVENTION

Figure 1:
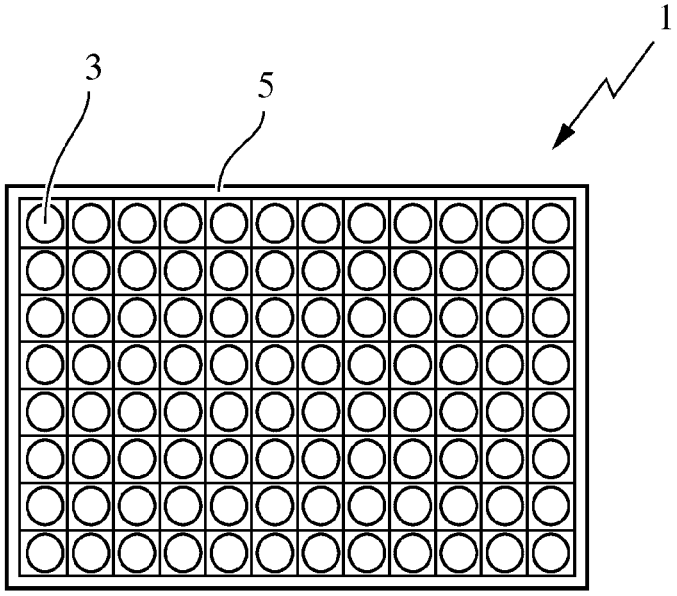
FIG. 1 shows the reactor array.

FIG. 1 shows the reactor array 1 according to the invention, which comprises a plurality of vessels 3, in this case in an 8×12 arrangement, which are arranged by way of example on a plate 5. The arrangement of the vessels 3 is preferably equidistant in a uniform pattern.

Figure 2:
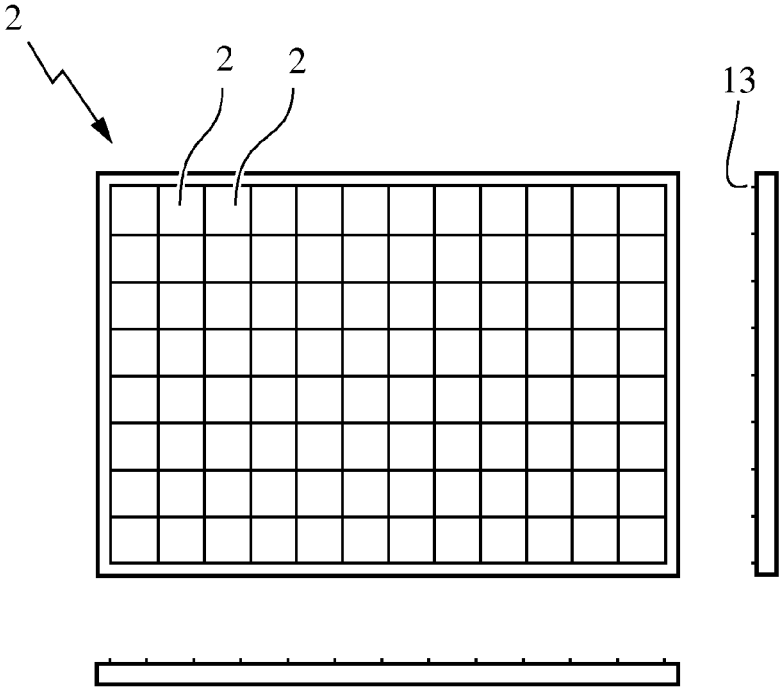
FIG. 2 shows three views of the lid.

FIG. 2 shows the associated lids schematically in three views. Each vessel comprises a lid having gastight seals 13, which is applied to a vessel in each case. In the present case, the lids are arranged so as to be interconnected. However, this need not be the case and/or is only the case at times. For example, it is possible to provide all of the lids in an integral component, to apply them to the vessels and subsequently to separate them from one another in such a way that each lid is subsequently present individually. However, it is also possible to interconnect the lids via webs or the like. In this case, these webs may also subsequently be broken if required. However, the lids preferably remain interconnected. They remain on the vessel during the production of the respective product and/or until the vessels are arranged on the plate, and are subsequently preferably removed for the analysis and optionally subsequently applied to the vessels again. The individual vessels can be held together by interconnected lids.

Figure 3:
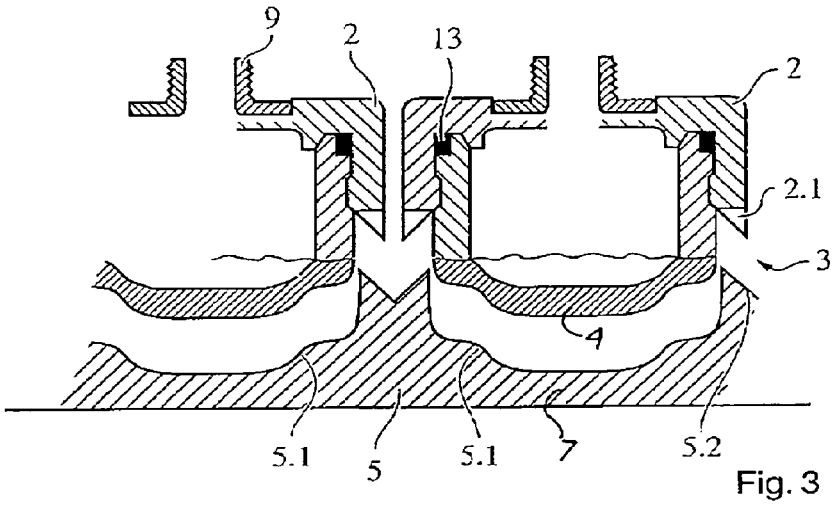
FIG. 3 shows a first embodiment of the vessel with the lid.

FIG. 3 shows a first embodiment of the vessel 3, which is provided with a lid 2. A seal 13 is located between the lid and the vessel. The vessel is manufactured from two materials in the present case, the base exhibiting a low x-ray absorptance, but need not necessarily be so. Means for positioning process-related equipment, such as a reflux condenser system, and/or a metering system are arranged on the lid 2. On the lower edge thereof, the lid comprises two positive connection means 2.1, which cooperate with positive connection means 5.2 of the plate arranged below and thus fix the vessel along with the support in a completely fixed position, and this is advantageous for the transfer of heat and for the mixing process. The plate 5 located below further comprises heat exchange surfaces 5.1, with which the vessel 3 can be heated or cooled, the shape of the heat exchange surfaces preferably being matched to the shape of the base of the vessel. In the present case, the lids 2 are shown without any connection to one another, but this need not be the case or is only the case at times.

Figure 4:
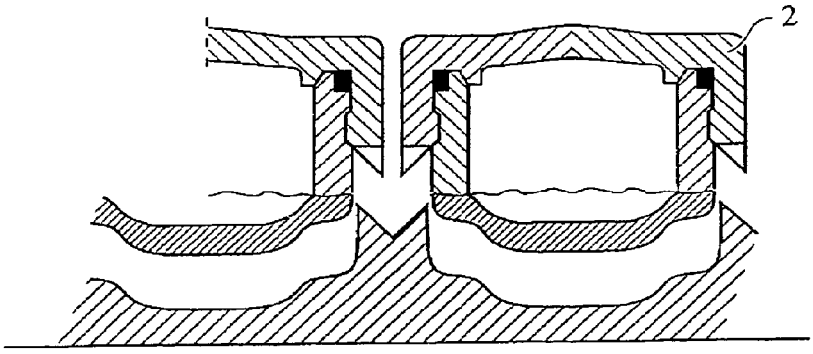
FIG. 4 shows a second embodiment of the vessel with the lid.

FIG. 4 basically shows the vessel 3 along with the lid 2, the lid not comprising any means 9 for positioning process-related equipment and/or metering means 15 in the present case. The lid including the positioning process-related equipment means 9 and metering means 15 is shown in FIG. 3.

Figure 5:
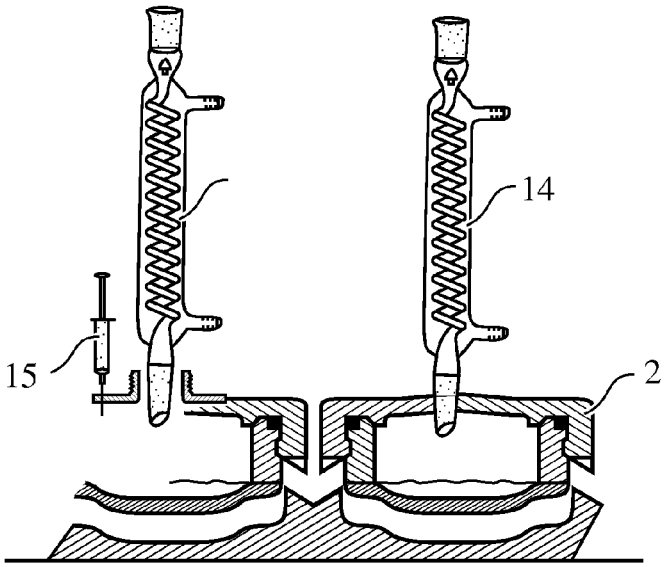
FIG. 5 shows process-related means and metering means in the lid.

In an extension of the example according to FIG. 3, FIG. 5 shows the positioning of process-related equipment 14, in this case a reflux condenser, on the lid 2. It can further be seen that the lid 2 comprises a recess through which it is possible to guide a metering unit, in this case a syringe, with which a solid, liquid or gas can be injected into the vessel.

Figure 6:
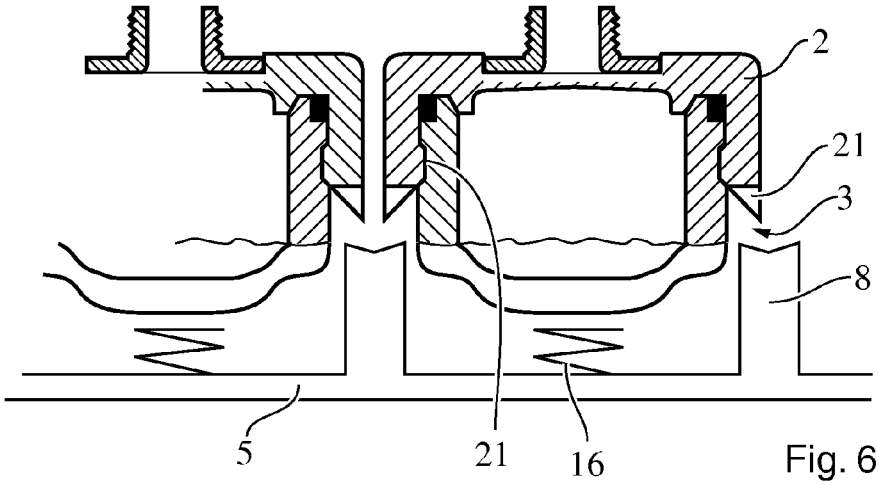
FIG. 6 shows an ejector.

In the embodiment according to FIG. 6, the plate 5 comprises ejectors 8, the upper ends of which cooperate with the positive connection means 2.1 of the lid when the vessels 3 are lowered along with the lids 2 and thereby spread the lids outwards. In this way, a positive and/or non-positive connection 21 which fastens the lid 2 onto the vessel 3 can be released and the lid 2 can be removed. Further, in the present case the plate 5 comprises a spring means 16 with which the downward movement of the vessel 3 can be cushioned.

Figure 7:
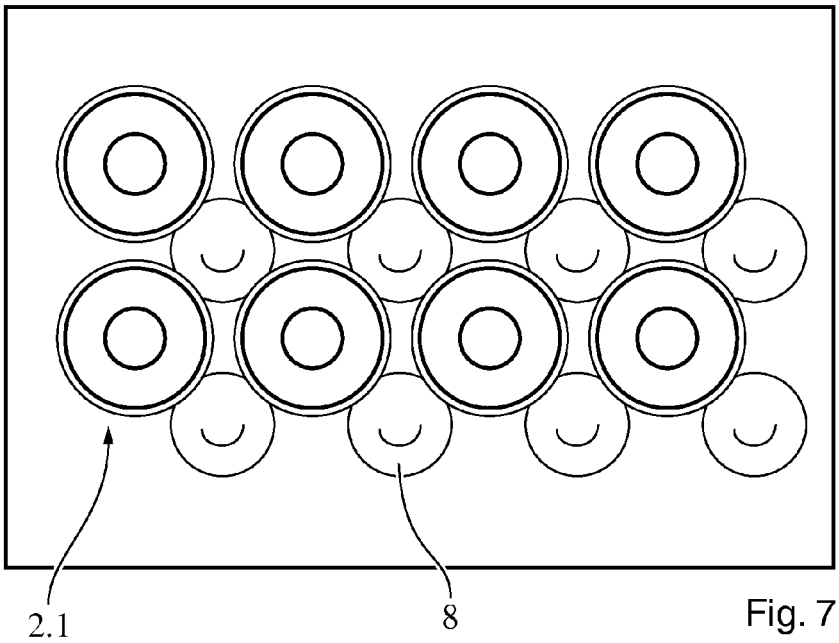
FIG. 7 shows a further embodiment of the ejector.

As can be seen from FIG. 7, each ejector 8 is arranged between four lids 2, each lid comprising a plurality of clamps 2.1, in this case four, with which a releasable positive and/or non-positive connection to the vessel 3 can be produced.

Figure 8:
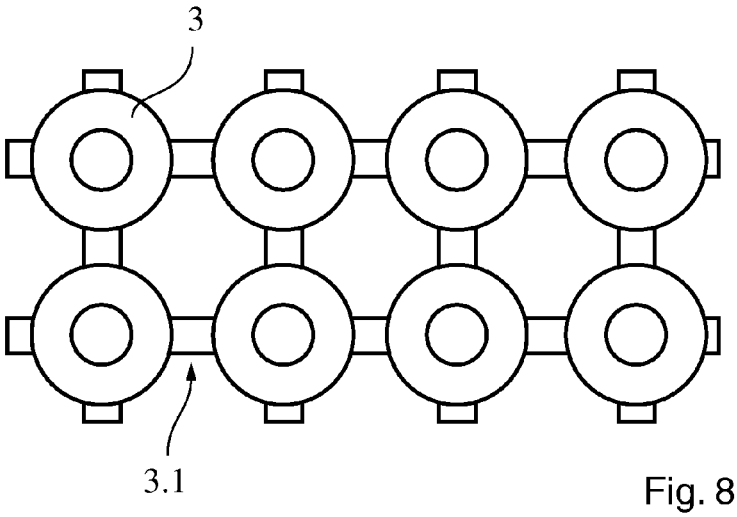
FIG. 8 shows interconnected vessels.

FIG. 8 shows that the vessels 3 may also be interconnected by webs 3.1. In this way, all of the vessels 3 may for example be positioned on a plate 5 simultaneously and/or heat may be exchanged between the vessels via the webs 3.1. The connection 3.1 may be released selectively by cutting it.

Figure 9:
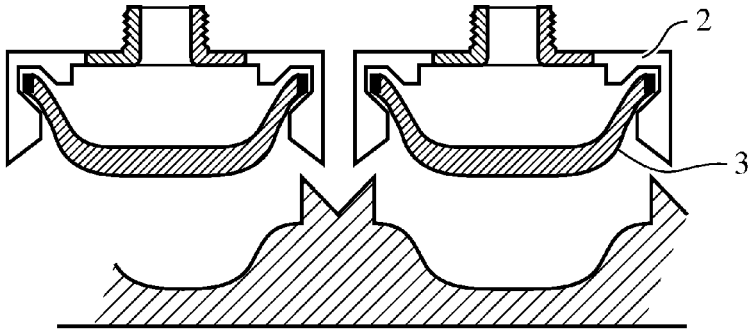
FIG. 9 shows a particularly planar embodiment of the vessel.

FIG. 9 shows a particularly planar embodiment of the vessel 3. This vessel is adapted in particular for x-ray powder diffractometry. Otherwise, reference is made to the embodiment of FIG. 3.

Figure 10:
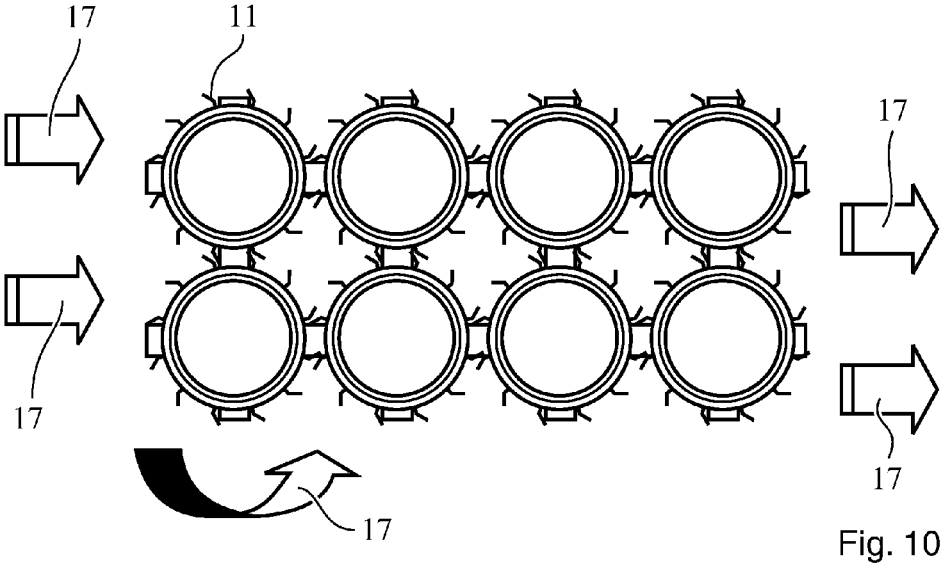
FIG. 10 shows a first embodiment of rotatably arranged vessels.

FIG. 10 shows an embodiment of the present invention in which the vessel 3 and/or the lid 2 thereof and/or the support thereof are provided with drive means 11. In the present case, the drive means 11 are blades which are arranged with uniform spacing along the periphery of the vessel or of the lid or along the support thereof and against which an airstream 17 may flow if required, said airstream driving the vessels 3 and/or lids 2 and/or the support thereof in rotation. It can further be seen in FIG. 10 that an airstream can also be guided against the vessel and/or the mounting thereof laterally and/or from below, for example to reduce the frictional resistance between the vessel 3 and the support thereof and/or between the support and the plate positioned below and/or to drive the vessel.

Figure 11:
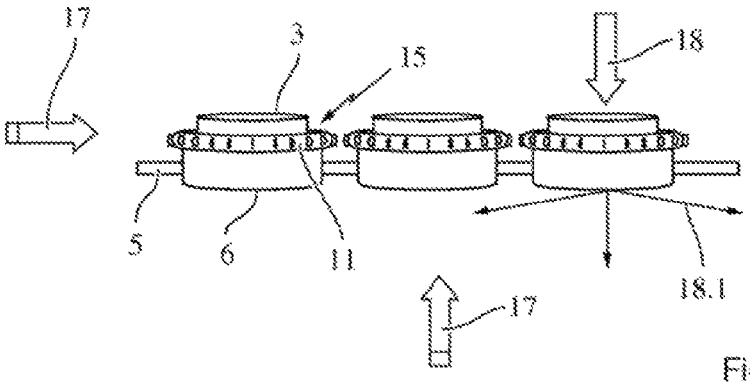
FIG. 11 shows drive means for the vessel.

FIG. 11 shows an insert 19 which is provided with air blades 11 and arranged in a mounting 6 of the plate 5. The vessel 3 is arranged in the insert 19. In this case, too, the blades 11 are driven by air. The person skilled in the art will appreciate that the drive means 11 may also be belts or toothed wheels or any other means with which force and/or a torque can be applied for driving the vessel 3 in rotation.

Figure 12:
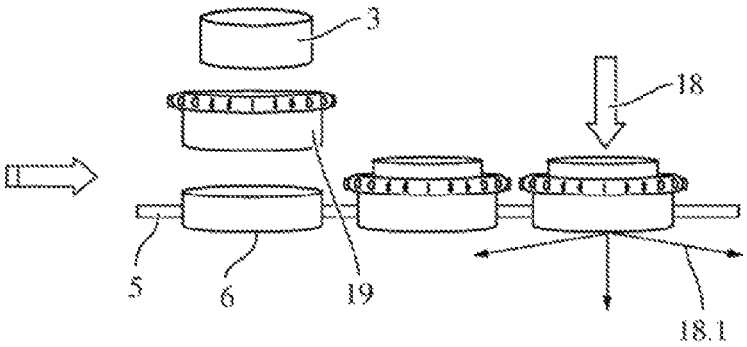
FIG. 12 shows the assembly of the arrangement according to FIG. 11.

FIG. 12 basically shows the view according to FIG. 11, but in this case it can be seen how the mounting 6, the insert 19 and the vessel 3 interact.

Figure 13:
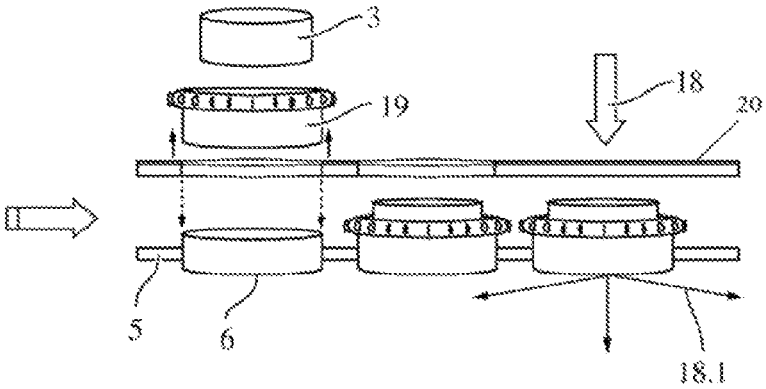
FIG. 13 shows a further example of the assembly of the means according to FIG. 11.

FIG. 13 basically shows the view of FIGS. 11 and 12, but in this case the inserts 19 are arranged on a plate 20 and can be lowered into the mounting 6 by means of the plate 20.

LIST OF REFERENCE NUMERALS

1 reactor array
2 lid, lid array
2.1 positive connection means
3 vessel, crucible
3.1 connecting web between two vessels
4 base of the vessel
5 plate
5.1 heat exchange surfaces
5.2 positive connection means
6 mounting of the vessels
7 heat exchange means
8 lid opener, ejector
9 means for positioning add-on units
10 sealing means, clamps
11 drive means
12 drivable support
13 seal
14 process-related equipment
15 metering means
16 spring means, cushioning
17 gas stream or liquid stream
18 x-ray
18.1 diffracted x-ray
19 insert
20 plate
21 positive and/or non-positive connection

The invention claimed is:

1. A reactor array (1) for producing and/or analyzing products comprising:

a plurality of vessels (3) for producing and/or analyzing the products, each vessel (3) comprising a base (4) manufactured from an x-ray-amorphous material having an x-ray transmittance in a wavelength range of approximately 0.45 Å to 2.5 Å, and a thickness less than or equal to approximately 5 mm, a plurality of lids (2), each one of the plurality of lids (2) is configured to be connected to a respective one of the plurality of vessels (3) forming a gastight seal (13) therebetween, a plate (5) on which the plurality of vessels (3) are mounted, and a plurality of inserts (19) each comprising a plurality of movable air blades (11) arranged at an angle relative to an external circumference of the insert (19), wherein the angle is not 90°, and wherein each of the plurality of inserts (19) configured to accommodate a respective one of the plurality of vessels (3).

2. The reactor array (1) according to claim 1, further comprising webs (3.1) interconnecting each of the plurality of vessels.

3. The reactor array (1) according to claim 1, wherein the plate (5) further comprises a plurality of lid ejectors (8).

4. The reactor array (1) according to claim 3, wherein the plurality of lid ejectors (8) are pushable against so as to loosen the lids (2) of the plurality of vessels (3) when the plurality of vessels (3) are lowered onto the plate (5).

5. The reactor array (1) according to claim 1, wherein each lid (2) has a recess defined therein.

6. The reactor array (1) according to claim 1, wherein each insert (19) is provided between each respective vessel (3) and corresponding mounting (6).

7. The reactor array (1) according to claim 6, wherein the plate (5) further comprises a mounting (6) in which the plurality of inserts (19) are each arranged and rotatable therein.

8. The reactor array (1) according to claim 6, wherein the airblades are rotatable in response to a stream of gas or a liquid stream.

9. The reactor array (1) as claimed in claim 1, wherein the plurality of individual lids (2) are arranged in a grid pattern to form a lid array.

10. The reactor array according to claim 9, wherein the lid array is manufactured from a relatively flexible material.

* * * * *